US009434530B2

(12) United States Patent
Cornwell

(10) Patent No.: US 9,434,530 B2
(45) Date of Patent: Sep. 6, 2016

(54) SELECTABLE, MULTIPLE CHAMBER CONTAINER HAVING SINGLE NOZZLE ASSEMBLY

(71) Applicant: Kristine Lyn Cornwell, The Colony, TX (US)

(72) Inventor: Kristine Lyn Cornwell, The Colony, TX (US)

(73) Assignee: KLC Product Innovation Corp., McKinney, TX (US)

( * ) Notice: Subject to any disclaimer, the term of this patent is extended or adjusted under 35 U.S.C. 154(b) by 147 days.

(21) Appl. No.: 13/963,773

(22) Filed: Aug. 9, 2013

(65) Prior Publication Data

US 2014/0014687 A1 Jan. 16, 2014

Related U.S. Application Data

(60) Provisional application No. 61/825,052, filed on May 19, 2013, provisional application No. 61/861,560, filed on Aug. 2, 2013.

(51) Int. Cl.

| | |
|---|---|
| ***B65D 35/22*** | (2006.01) |
| ***B65D 83/68*** | (2006.01) |
| ***B65B 31/00*** | (2006.01) |
| ***B65D 83/44*** | (2006.01) |
| ***B65D 83/62*** | (2006.01) |
| *B65D 83/16* | (2006.01) |

(52) U.S. Cl.

CPC ..... *B65D 83/68* (2013.01); *B65B 31/003* (2013.01); *B65D 83/44* (2013.01); *B65D 83/62* (2013.01); *B65D 83/16* (2013.01)

(58) Field of Classification Search

CPC ..... B65D 83/00; B65D 47/00; B67D 7/06; B67D 7/78

USPC ..... 222/129.1–141, 94, 105–106, 222/402.1–402.25, 144.5, 145.1, 144, 222/145.7–145.8, 325–326, 399, 476

See application file for complete search history.

(56) References Cited

U.S. PATENT DOCUMENTS

| | | | | |
|---|---|---|---|---|
| 3,236,418 | A | | 2/1966 | Dalle et al. |
| 3,568,888 | A | * | 3/1971 | Baldoni et al. ..... 222/94 |
| 3,595,440 | A | * | 7/1971 | Prussin et al. ..... 222/94 |
| 3,731,847 | A | | 5/1973 | Webster |
| 3,795,366 | A | * | 3/1974 | McGhie et al. ..... 239/397 |
| 3,861,570 | A | * | 1/1975 | Green ..... 222/402.17 |
| 3,918,612 | A | * | 11/1975 | Voulgaris ..... 222/144.5 |
| 4,838,457 | A | * | 6/1989 | Swahl et al. ..... 222/48 |
| 4,993,594 | A | * | 2/1991 | Becker et al. ..... 222/48 |

(Continued)

OTHER PUBLICATIONS

Variblend product www.variblend.com.

*Primary Examiner* — Paul R Durand
*Assistant Examiner* — Andrew P Bainbridge

(57) ABSTRACT

A container, a support cup coupled to the top of the container, a nozzle orifice from which product is dispensed is integrated with a cap. A barrel is integrated in the cap in communication with the nozzle orifice. A valve assembly is supported by the support cup, the valve assembly having an outlet, the outlet directly or indirectly coupled to and in communication with the barrel, the valve assembly further having an inlet. Three are a plurality of chambers or bags, each having a bag outlet. A plurality of valve assembly inlets allows ingress into the valve assembly. A blocking member selectively blocks the pathway from a bag outlet to a corresponding valve assembly inlet. A selection switch/lever/dial integrated in the cap is operable to open a pathway through the valve assembly to the nozzle so as to release product from a selected bag.

36 Claims, 11 Drawing Sheets

(56) References Cited

U.S. PATENT DOCUMENTS

| | | | | |
|---|---|---|---|---|
| 5,009,342 | A | 4/1991 | Lawrence et al. | |
| 5,411,176 | A * | 5/1995 | Favre | 222/94 |
| 5,634,571 | A * | 6/1997 | Cataneo et al. | 222/80 |
| 5,848,732 | A * | 12/1998 | Brugger | 222/137 |
| 6,308,863 | B1 | 10/2001 | Harman | |
| 6,540,112 | B1 * | 4/2003 | Studnik | 222/132 |
| 6,945,430 | B2 * | 9/2005 | Bloc | 222/135 |
| 7,455,195 | B2 * | 11/2008 | Mekata | 222/94 |
| 7,967,220 | B2 * | 6/2011 | Hansen et al. | 239/304 |
| 8,328,118 | B2 | 12/2012 | Hansen et al. | |

* cited by examiner

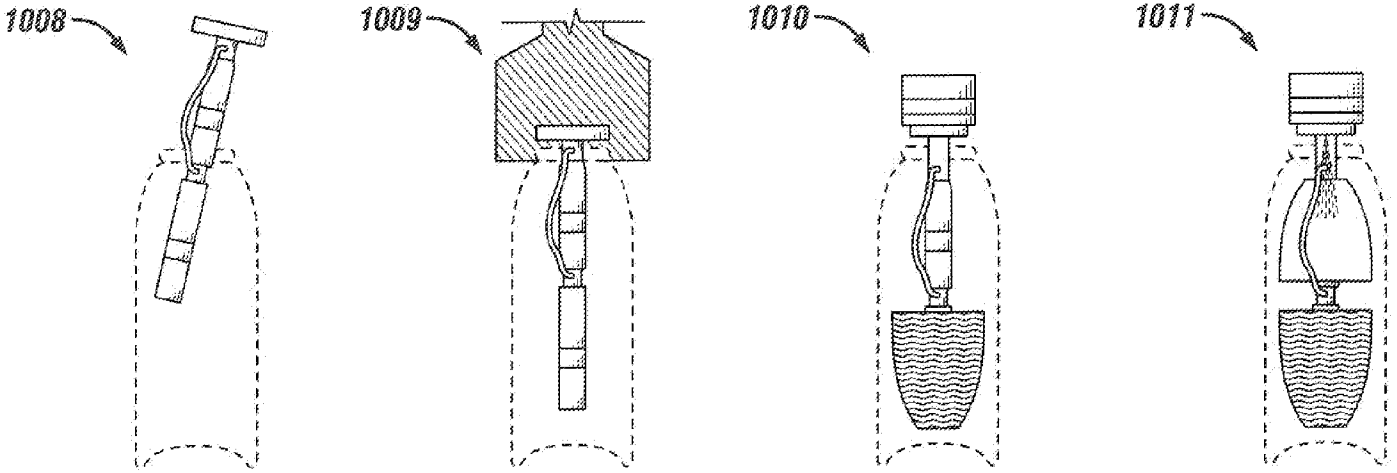
FIG. 10H
FIG. 10I
FIG. 10J
FIG. 10K
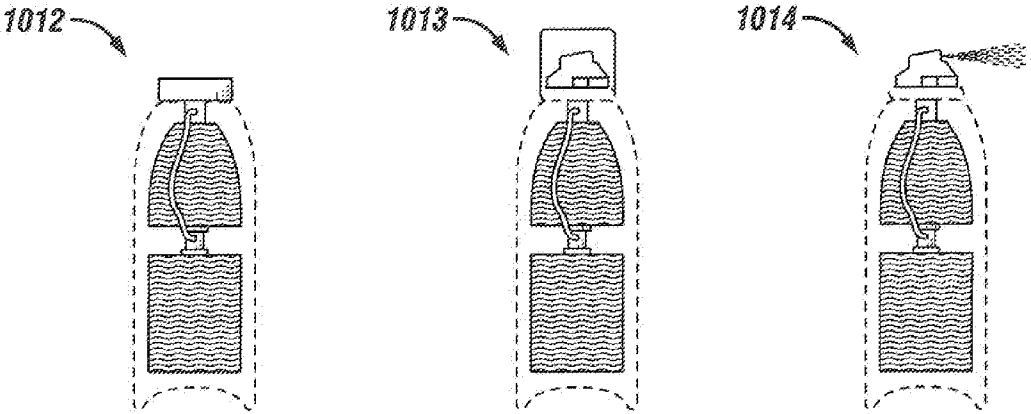
FIG. 10L
FIG. 10M
FIG. 10N

SELECTABLE, MULTIPLE CHAMBER CONTAINER HAVING SINGLE NOZZLE ASSEMBLY

CROSS-REFERENCE TO RELATED APPLICATIONS

This application relates to and claims priority to the following provisional applications: U.S. Ser. No. 61/825,052, filed May 19, 2013, titled: SMALL FORM FACTOR QUICK DRY SANITIZER WITH QUICK RELEASE MECHANISM AND METHOD; U.S. Ser. No. 61/958,167, filed Jul. 22, 2013, titled: QUICK DRY SANITIZER/DISINFECTANT APPARATUS AND METHOD; U.S. Ser. No. 61/958,267, filed Jul. 24, 2013, titled: VALVE MECHANISM AND SPRAY NOZZLE FOR AEROSOL CANISTER HAVING TWO CHAMBERS; U.S. Ser. No. 61/958,381, filed Jul. 26, 2013, titled: DISPENSING APPARATUS FOR CONTAINER HAVING MULTIPLE CHAMBERS, U.S. Ser. No. 61/958,395, filed Jul. 26, 2013, titled: MULTIPLE BAG-ON-VALVE APPARATUS AND METHOD; U.S. Ser. No. 61/958,518, filed Jul. 30, 2013, titled: VALVE ASSEMBLY FOR MULTI-CHAMBER CONTAINER, and U.S. Ser. No. 61/861,560. Filed Aug. 2, 2013, entitled MULTI-CHAMBER AEROSOL CONTAINER AND NOZZLE ASSEMBLY, all of which are incorporated herein by reference.

FIELD OF THE INVENTION

The invention relates to a packages and containers used to hold and dispense products, methods of filling such packages and containers, methods of making such packages and containers, and methods of using such packages and containers.

BACKGROUND

Bag-on-Valve (BoV) is a packaging technology for pharmaceutical, over the counter, food and healthcare products. A BoV system consists of a rolled-up multi-layered flexible pouch attached to an aerosol valve. In the production of a BoV product, compressed air or nitrogen is injected into the canister, and an aerosol valve with the bag attached is crimped onto the container. The formulation is forced through the aerosol valve stem to fill the bag. Finally, the actuator and cap are put in place.

U.S. Pat. No. 8,328,118 to Hansen et al., discloses a manual spray dispenser for dispensing a mixture of two compositions comprises a container having a first and second chamber and a single dispensing spray outlet. Disadvantageously, the invention of Hansen requires two separate manual pump mechanisms.

SUMMARY OF THE INVENTION

An apparatus of dispensing a plurality of products, comprising a nozzle assembly having a nozzle from which product is dispensed or sprayed from a plurality of bag-on-valve bags and an actuator appurtenant to the nozzle assembly operable to release product from a selected bag and a switch/lever/dial is responsively coupled to the nozzle assembly operable to select the bag from which the product is to be ejected when the actuator is depressed or otherwise actuated. A plurality of bags in combination with the nozzle assembly have conduits from the interior thereof into the nozzle assembly, which conduits can be opened and closed via the switch/lever/dial. The bags are flexible, multiple layer bags. A cap supports the nozzle assembly and is coupled to a container.

Propellant is sealed inside the container in which the bags have been positioned and/or within any one or any of the plurality of the bags.

In preferred embodiments, the invention has two bags. In a further embodiment one of the bags contains sanitizer/disinfectant in a first bag and a quick drying agent in a second bag. In a further embodiment, a first bag holds sunscreen having a first sunscreen protection factor (SPF) and a second bag holds sunscreen having a second SPF. In a further embodiment, a first bag holds sunscreen and a second bag holds after sun care spray. In a further embodiment, a first bag holds a first type of household cleaner and a second bag holds a second type of household cleaner.

Although the invention is described as having two bags, any desired number of bags can be provided in the container. Further, any suitable product that is desired can be placed in a respective bag chamber so long as it can be ejected from its respective bag upon activation of the actuator.

BRIEF DESCRIPTION OF THE DRAWINGS

Other features of the invention will become clear from the following description, taken together with the accompanying drawings, wherein:

FIGS. 10H-10N illustrate an alternative way to perform the steps of FIG. 9;

DESCRIPTION OF THE INVENTION

Figure 1:
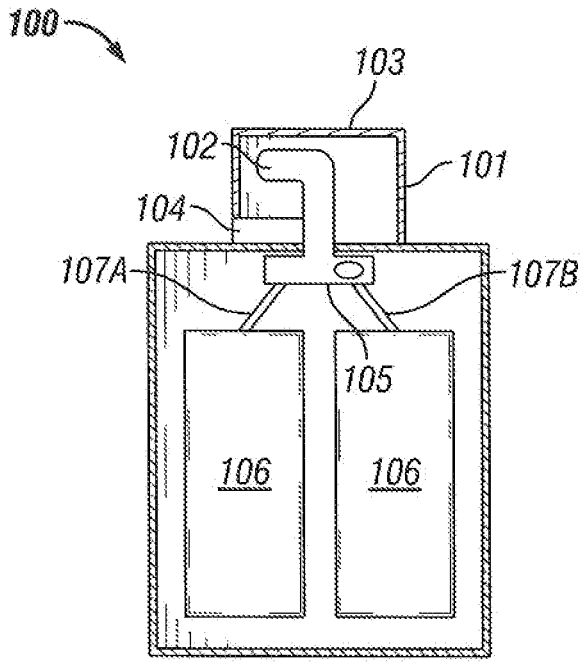
FIG. 1 is a block diagram of the apparatus of the invention.

FIG. 1 is a block diagram of the apparatus 100 of the invention having a nozzle assembly 101 having a nozzle 102 from which product is dispensed or sprayed from a plurality of bag-on-valve bags, an actuator 103 appurtenant to the nozzle assembly 101 operable to release product from a selected bag and a switch/lever/dial 104 movably coupled to the nozzle assembly 101 and responsively coupled to a blocking/unblocking member 105, operable to select the bag from which the product is to be ejected when the actuator 103 is depressed or otherwise actuated. A plurality of bags 106 have conduits 107A, 107B from the interior thereof into the nozzle assembly 101, which conduits 107A, 107B can be opened and closed using the blocking/unblocking member 105 via the switch/lever/dial 104.

The invention comprises a nozzle assembly having a nozzle from which product is dispensed or sprayed from a plurality of bag-on-valve bags. The invention further includes a plurality of bags in combination with the nozzle assembly. The invention further includes product within the plurality of bags in combination with the bags and the nozzle assembly. The invention further includes a cap supporting the nozzle assembly. The invention further includes a container to which the cap is coupled. A bag can be a flexible, multiple layer bag. The nozzle assembly includes an actuator that is operable to release product from a selected bag. A switch/lever/dial is responsively coupled to the nozzle assembly to select the bag from which the product is to be ejected when the actuator is depressed or otherwise actuated. Propellant can be included in one or any plurality of the bags or can be sealed inside a container in which the bags have been positioned. The bags are dimensioned and deployed so that when each is filled, it expands in a space that does not substantially interfere with a space assigned to another bag. In preferred embodiments, the invention has two bags.

A further aspect of the invention is an apparatus for dispensing a plurality of products, comprising a nozzle assembly having a nozzle or orifice from which product is dispensed or sprayed from a plurality of selectable bag-on-valve bags, an actuator appurtenant to the nozzle assembly operable to release product from a selected bag-on-valve bag and a switch/lever/dial movably coupled to the nozzle assembly and responsively coupled to a blocking/unblocking member, operable to select a bag-on-valve bag from which the product is to be ejected when the actuator is depressed or otherwise actuated. In a further embodiment, a cap is appurtenant to the nozzle assembly and acts as a dial to select, via the nozzle assembly, which bag-on-valve bag from which product is to be sprayed or dispensed.

Figure 3:
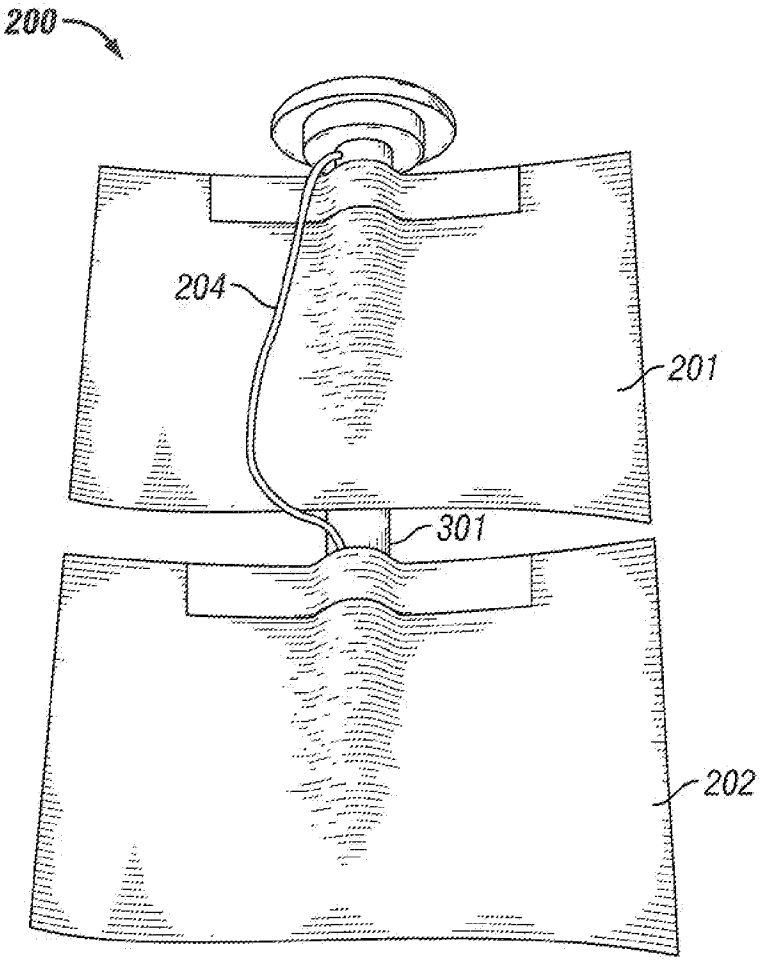
FIG. 3 is a multiple bag-on-valve pre-deployment unrolled.
Figure 2:
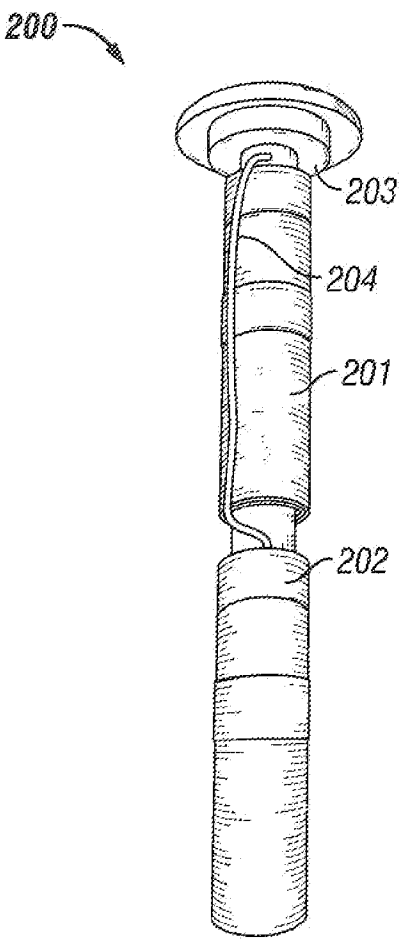
FIG. 2 is a multiple bag-on-valve pre-deployment, rolled and taped.
Figure 11:
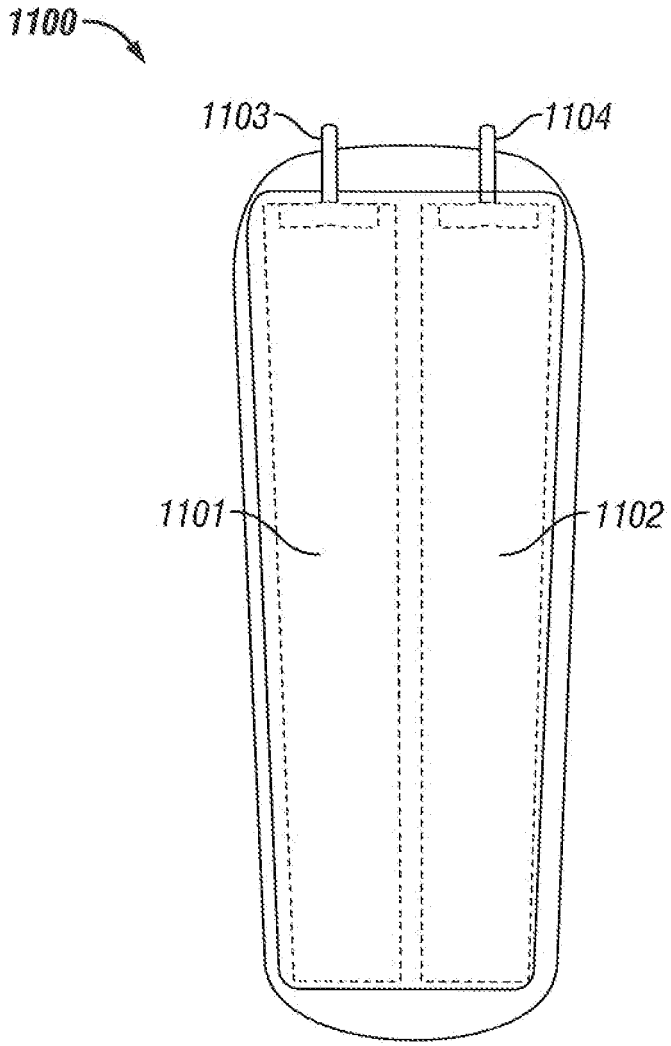
FIG. 11 is an embodiment of one outer layer holding multiple internal bags.

FIG. 2 illustrates a rolled and taped, pre-deployed bag-on-valve 200. As seen therein, there is an upper bag 201 and lower bag 202. Upper bag has a conduit 203 into a valve assembly and a conduit 204 into the valve assembly. The conduit 204 can comprise a dip tube. In an alternative embodiment, the conduit 204 can be inside rolled bag 201, being exposed, as seen in FIG. 3, when bag 201 is unrolled, for example, in the filling process. FIG. 3 shows the bag-on-valve 200 in an unrolled position. A straight, angled or flexible conduit 301 is provided into the interior of the lower bag 202 for a dip tube 204. FIG. 3 is a two bag-on-valve pre-deployment in an unrolled position. Each/either bag can be a mylar, polyethylene or polypropylene bag or similar composition or can comprise multiple layers of one or more flexible materials laminated together. The layers can comprise any combination of polyethylene terephthalate, adhesive layers, aluminum layer polyamide layer, and/or polypropylene layer. The layers are hermetically sealed to the valve housing or conduit leading to the valve assembly or nozzle assembly. The outer layer of the bag can a one layer, or an integral piece, the inner layers being separated using fusion or weld to create the second chamber or the inner layers can be separate bags within the one outer layer. A separate conduit would then couple the second bag or chamber to the valve assembly or nozzle assembly. These separate chambers with a single unified outer layer can be arranged vertically or side by side. In the side by side arrangement, two internal chambers 1101, 1102, having conduits 1103, 1104, respectively, can be formed in a single bag 1100 as seen in FIG. 11.

In a further embodiment one of the bags contains sanitizer/disinfectant in a first bag and a quick drying agent in a second bag. In a further embodiment, a first bag holds sunscreen having a first sunscreen protection factor (SPF) and a second bag holds sunscreen having a second SPF. In a further embodiment, a first bag holds sunscreen having a first sunscreen protection factor (SPF) with a normal usage and a second bag holds sunscreen having a the same SPF, but for a different use, such as sweat-proof. In a further embodiment, a first bag holds sunscreen and a second bag holds after sun care spray. In a further embodiment, a first bag holds a first type of household cleaner and a second bag holds a second type of household cleaner.

Although the invention is described as having two bags, any desired number of bags can be provided in the container. Further, any suitable product that is desired can be placed in a respective bag chamber so long as it can be ejected from its respective bag upon activation of the actuator.

Figure 4:
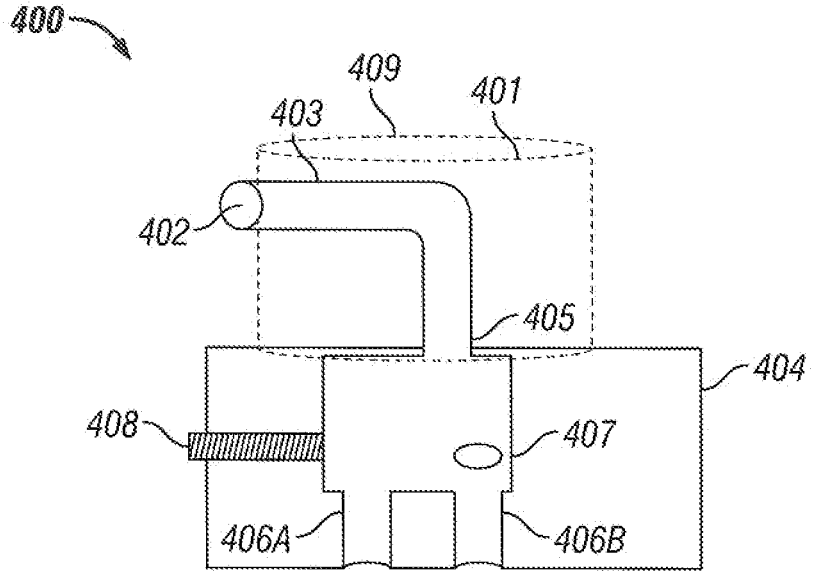
FIG. 4 is a block diagram of a nozzle assembly of the invention.

FIG. 4 is a block diagram of a nozzle assembly/valve assembly 400 of the present invention. The components of nozzle assembly/valve assembly 400 include a head 401, a nozzle on the head from which product is dispensed or sprayed 402, a straight, curved or angled barrel 403 in communication with the nozzle; a valve assembly 404 having an outlet 405, the outlet directly or indirectly coupled to and in communication with the barrel 403, the valve assembly 404 a plurality of valve assembly inlets 406A, 406B, equal to the number of bag outlets; a blocking member 407 operable to selectively block the pathway from a respective bag outlet to a corresponding valve assembly inlet 406A, 406B and a selection switch/lever/dial 408 operable to move an aperture in the blocking member to be in alignment with a selected one of the valve assembly inlets and an actuator 409 operable to open a pathway through the valve assembly to the nozzle so as to release product from a selected bag.

The invention is also an apparatus of dispensing a plurality of products, comprising a nozzle assembly having a nozzle from which product is dispensed or sprayed from a plurality of bag-on-valve bags; an actuator appurtenant to the nozzle assembly operable to release product from a selected bag; and a switch/lever/dial is responsively coupled to the nozzle assembly operable to select the bag from which the product is to be ejected when the actuator is depressed or otherwise actuated. The invention further comprises a plurality of bags in combination with the nozzle assembly, the plurality of bags having conduits from the interior thereof into the nozzle assembly, which conduits can be opened and closed via the switch/lever/dial. The bags can be flexible, multiple layer bags. The invention also comprises product within the plurality of bags in combination with the bags and the nozzle assembly. The invention further comprises a cap supporting the nozzle assembly; and a container to which the cap is coupled. The invention further comprises propellant sealed inside the container in which the bags have been positioned. The invention further comprises propellant within any one or any plurality of the bags. The bags of the invention are dimensioned and deployed so that when each is filled, it expands in a space that does not substantially interfere with a space assigned to another bag.

In preferred embodiments, the invention has two bags. In a further embodiment one of the bags contains sanitizer/disinfectant in a first bag and a quick drying agent in a second bag. In a further embodiment, a first bag holds sunscreen having a first sunscreen protection factor (SPF) and a second bag holds sunscreen having a second SPF. In a further embodiment, a first bag holds sunscreen and a second bag holds after sun care spray. In a further embodiment, a first bag holds a first type of household cleaner and a second bag holds a second type of household cleaner.

Although the invention is described as having two bags, any desired number of bags can be provided in the container. Further, any suitable product that is desired can be placed in a respective bag chamber so long as it can be ejected from its respective bag upon activation of the actuator.

The invention further comprises an apparatus of dispensing a plurality of products, comprising a container; a head proximate the top of the container; a nozzle on the head from which product is dispensed or sprayed; a straight, curved or angled barrel in communication with the nozzle; a valve assembly having an outlet, the outlet directly or indirectly coupled to and in communication with the barrel; a plurality of chambers each chamber comprising a bag, each bag having at least one bag outlet; a plurality of valve assembly inlets, equal to the number of bag outlets; a blocking member operable to selectively block the pathway from a respective bag outlet to a corresponding valve assembly inlet; a selection switch/lever/dial operable to move an aperture in the blocking member to be in axial alignment with a selected one of the valve assembly inlets; and an actuator operable to open a pathway through the valve assembly to the nozzle so as to release product from a selected bag.

In preferred embodiments, the invention has two bags. In a further embodiment one of the bags contains sanitizer/disinfectant in a first bag and a quick drying agent in a second bag. In a further embodiment, a first bag holds sunscreen having a first sunscreen protection factor (SPF) and a second bag holds sunscreen having a second SPF. In a further embodiment, a first bag holds sunscreen and a second bag holds after sun care spray. In a further embodiment, a first bag holds a first type of household cleaner and a second bag holds a second type of household cleaner.

Although the invention is described as having two bags, any desired number of bags can be provided in the container. Further, any suitable product that is desired can be placed in a respective bag chamber so long as it can be ejected from its respective bag upon activation of the actuator.

A further embodiment is an apparatus for dispensing a plurality of products, comprising a container, a support cup coupled via a gasket to the top of the container, and a cap. A nozzle orifice from which product is dispensed or sprayed integrated with the cap and a straight, curved or angled barrel integrated in the cap in communication with the nozzle orifice. A valve assembly is supported by the support cup, the valve assembly having an outlet, the outlet directly or indirectly coupled to and in communication with the barrel, the valve assembly further having an inlet. A plurality of chambers each chamber comprising a bag, each bag having at least one bag outlet. A plurality of valve assembly inlets, equal to the number of bag outlets is provided. A blocking member is operable to selectively block the pathway from a respective bag outlet to a corresponding valve assembly inlet. A selection switch/lever/dial is integrated in the cap operable to move an aperture in the blocking member to be in axial alignment with a selected one of the valve assembly inlets and an actuator is operable to open a pathway through the valve assembly to the nozzle so as to release product from a selected bag.

Figure 5:
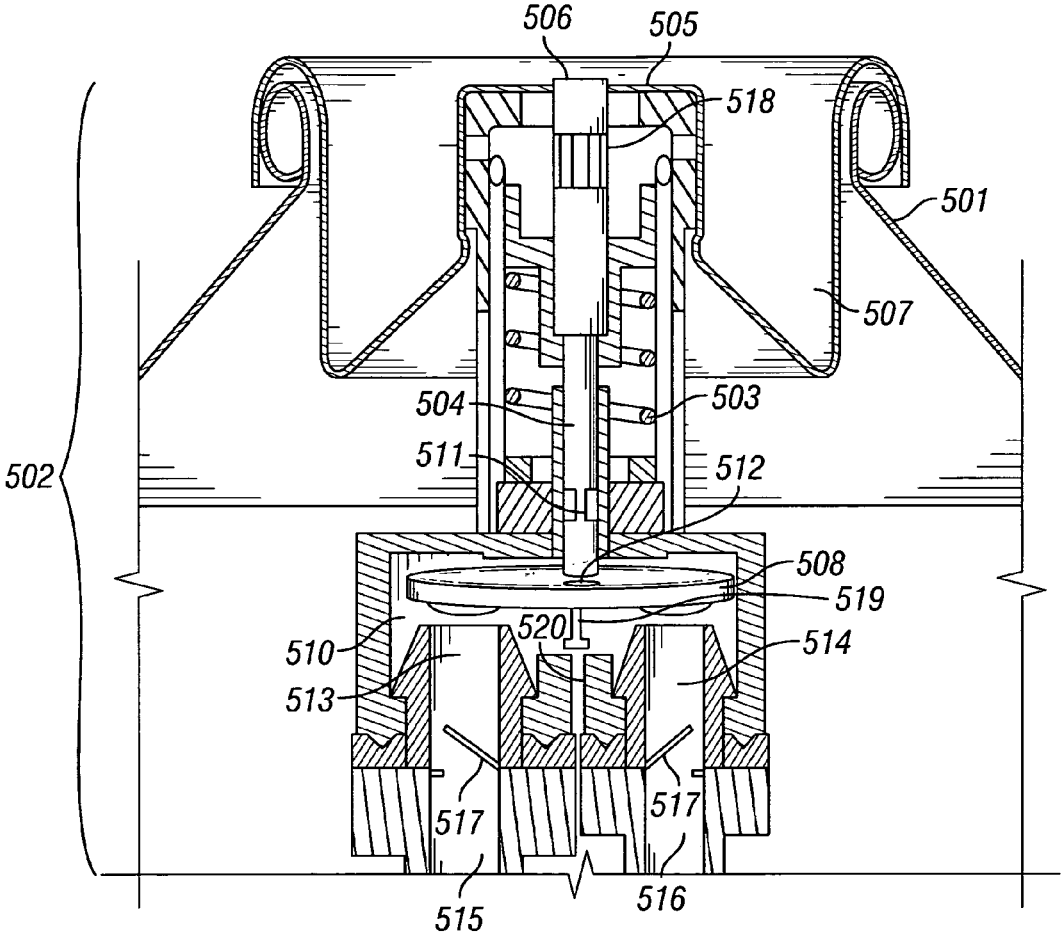
FIG. 5 is an embodiment of a nozzle assembly in the open position.
Figure 6:
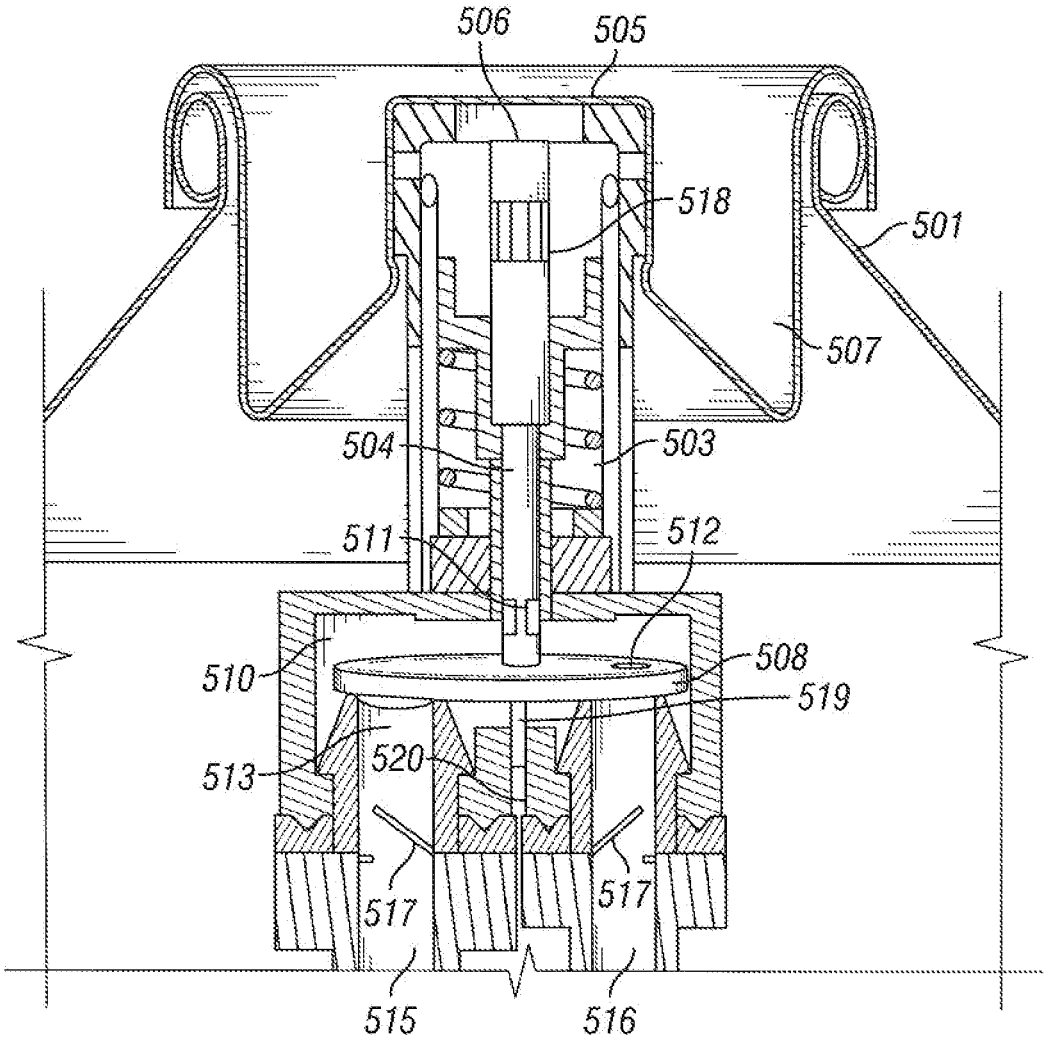
FIG. 6 is an embodiment of a nozzle assembly in the closed position.
Figure 7:
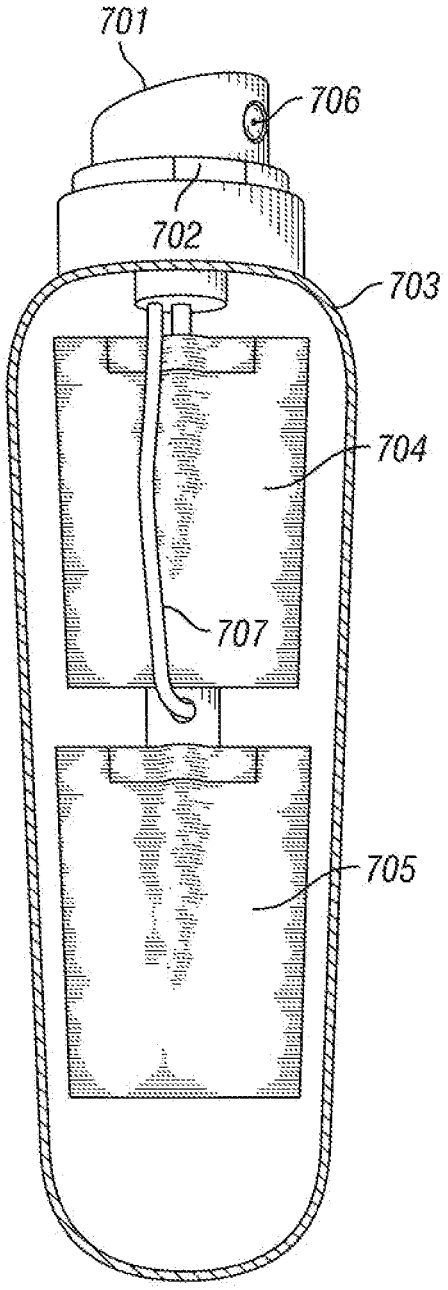
FIG. 7 is an embodiment of the use of the invention with two bags positioned vertically.

As seen in FIGS. 5, 6 and 7, the invention comprises a container 501, to be sealed, with a head having a nozzle 706 from which product is dispensed or sprayed, a barrel in communication with the nozzle, a nozzle actuator, which may comprise the top of the nozzle or head or a pushbutton actuator, a valve assembly 502 having a spring 503, a hollow valve stem 504, the spring 503 being axially inserted into the valve stem 504 and seated so as to spring load the valve stem 504 within a valve stem support cylinder 505, a valve stem egress 506 at the top of the valve stem, the valve stem egress coupled to the head and/or and in communication with the barrel, the valve stem egress 506 acting as a conduit from the hollow valve stem 504 into the barrel, a valve stem support cylinder 505 coupled to a cup 507 (which is sealed against the container) is provided in which the valve stem 504 is movable vertically in a reciprocating manner when the nozzle actuator is depressed and then released, the valve stem 504 further rotatable in a circular fashion within the valve stem support cylinder 505, a circular disk 508 axially coupled to the bottom of the valve stem 504 and operable to close off the bottom of the valve stem 504, the circular disk 508 further operable to rotate when the valve stem 504 is rotated, a disk chamber 510 in which the circular disk 508 is free to move vertically in a reciprocating manner when the valve stem 504 is depressed and free to move around its center axis when the valve stem 504 is rotated, the valve stem 504 further having a valve stem aperture 511 on a side wall of the valve stem 504 proximate the bottom of the valve stem 504, the valve stem aperture 511 being closed off against the inner wall of the valve stem support cylinder 505 when the nozzle actuator is in an undepressed position and exposed and open into the disk chamber 510 when the valve stem 504 is in a depressed position, the disk 508 having at least one disk aperture 512 therethrough; a first chamber egress 513 (such as a hollow tube or dip tube) acting as a conduit 515 from a first chamber and a second chamber egress 514 (also such as a hollow tube or dip tube) acting as a conduit 516 from a second chamber, wherein the at least one disk aperture 512 can be either in a closed position, meaning the at least one disk aperture 512 is not in co-axial alignment with either the first chamber egress 513 or the second chamber egress 514, or in a first chamber open position meaning the disk aperture 508 is in alignment with the first chamber egress 513, allowing a conduit from the first chamber, into the disk chamber 510. When the nozzle actuator is depressed, there is an open conduit from the first chamber into the disk chamber 510 through the valve stem 504 and out the nozzle. In a second chamber open position the disk aperture 508 is in alignment with the second chamber egress 514, allowing a conduit 516 from the second chamber 705, into the disk chamber 510, then when the nozzle actuator is depressed, there is an open conduit from the second chamber 705 into the disk chamber 510 through the valve stem 504 and out the nozzle 706. Within the first chamber egress 513, or between the first chamber 704 and the first chamber egress 513, there can be provided a flapper or one way valve 517 to keep product from the second chamber 705 from entering the first chamber 704. Within the second chamber egress 514, or between the second chamber 705 and the second chamber egress 514, there can be provided a flapper or one way valve 517 to keep product from the first chamber 704 from entering the second chamber 705. In an aspect, the circular disk 508 can include a flexible stopper on the underside thereof dimensioned to fit over the blocked first chamber egress 513 or blocked second chamber egress 514, as the case may be. Instead of a blunt edge on the flexible stopper, the flexible stopper can be graduated so that it slides over the egress to be blocked. In a further embodiment, the functionality performed by the flexible stopper can be performed by a raised portion of the underside of the circular disk 508. The chambers of this invention can be separate tin or aluminum chambers within a container 703 or plastic bags or bags as used in a bag on valve systems. In an embodiment, the valve assembly 502 can be coupled to the top of a container 501, such as an aluminum, plastic, PET or tin container and the chambers located therein. The spring used to spring load the valve stem, is preferentially a compressible spring, but depending on the implementation of the components, can be an expansion spring or a flexible material such as a rubber cylinder that is operable to expand and compress and thus allow the valve stem to reciprocate in the valve stem support cylinder.

Figure 12:
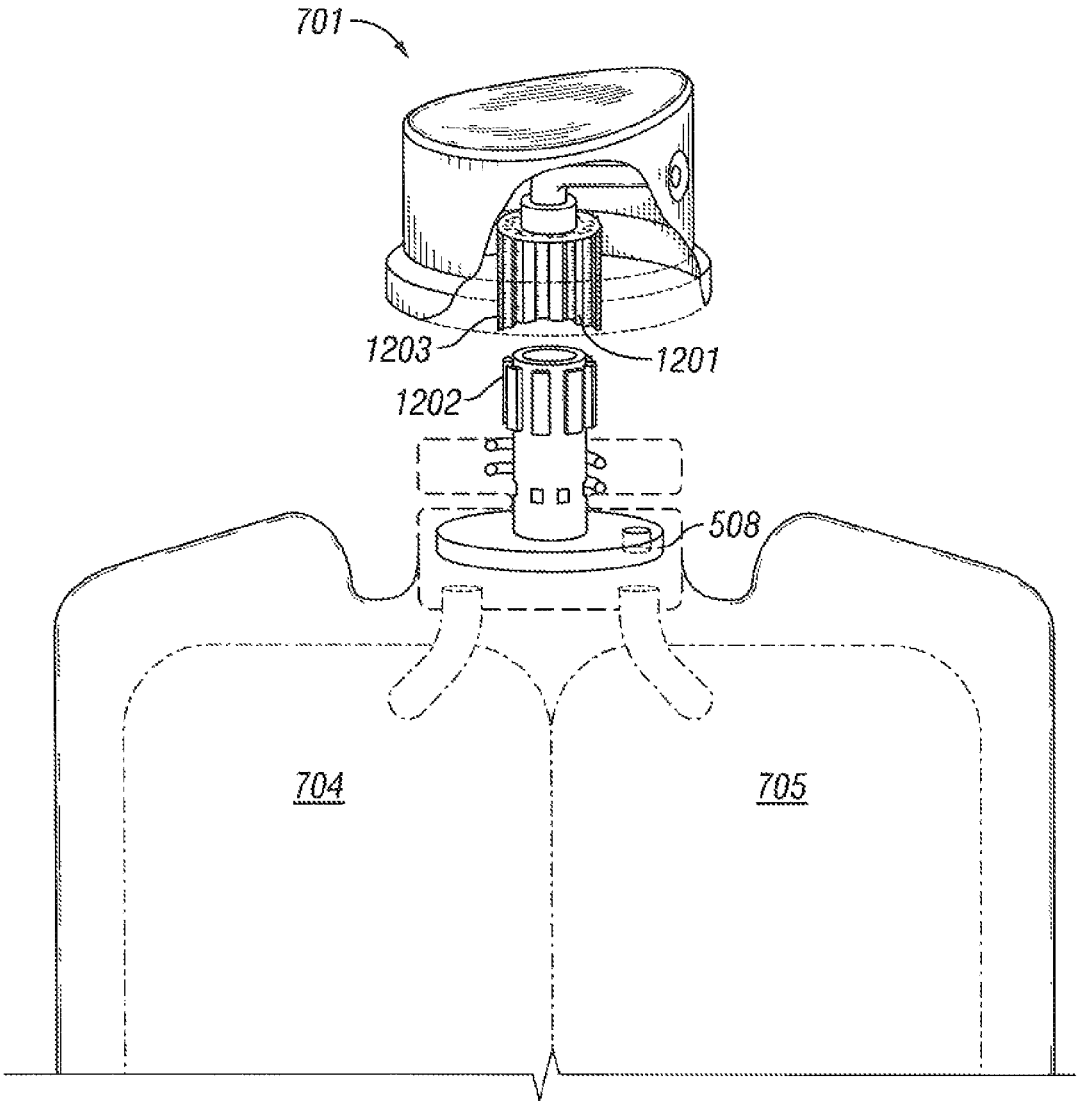
FIG. 12 is an illustration of a splined portion of a valve stem and an interior splined portion of a pushbutton actuator.

A selection switch/lever/dial 702 coupled to the valve stem 504 is operable to rotate the valve stem 504, and hence the disk 508, and hence the disk aperture 512, so as to select which chamber from which product is to be ejected from the nozzle 706. A longitudinal splined portion 518 around an upper, exposed portion of the valve stem 504 is provided to mate with a corresponding interior splined portion of a nozzle head, actuator or push button actuator as further described. As seen in FIG. 12, a nozzle head, actuator or pushbutton actuator 701 has interior splines 1201 on an interior, hollow cylindrical portion thereof 1203 corresponding to, and mating with valve stem splines 1202, the hollow cylindrical portion thereof operable to receive the valve stem, and when the splines are mated, operable to allow the nozzle head or pushbutton actuator 701 to twist the valve stem, thus rotating the disk 508 to allow a user to select the first chamber 704 or second chamber 705. In this embodiment, the selection switch/lever/dial 702 is the same as the nozzle head, actuator or pushbutton actuator 701. The nozzle head, actuator or pushbutton actuator 701 hence is coupled to the mechanism that selects the chamber or bag. To prevent the nozzle head, actuator or pushbutton head 701 from being depressed without a chamber having been selected, a disk key 519 is provided on the disk face opposite the disk face coupled to the valve stem 504, which is operable to fit into a disk chamber keyhole 520 located on the floor of the disk chamber 510 only when the selection switch/lever/dial 702 is selecting either the first chamber 704 or second chamber 705. The mating between a key and keyhole can be located in any position within the nozzle assembly or valve assembly so long as it is operable to prevent the nozzle head, actuator or pushbutton head 701 from being depressed without a chamber having been selected. In addition to allowing selection of a chamber, such mechanism can also be used to provide a locked position, for example, for child safety purposes. A further embodiment includes a propellant in the interior of the sealed container, thus surrounding the outside of the plurality of the bags. In an alternative embodiment, propellant may be included with the product in one or a selected number of the bags.

The disk 508 can be replaced with any suitable member, including gaskets and having conduits and apertures so as to perform the functionality of the disk, which is to block product from one chamber while allowing product from another, to enter valve stem 504. Any suitable blocking member can be used in lieu of the disk so as to allow product from a first chamber to be ejected from the nozzle while simultaneously blocking product from being ejected from the second chamber, and vice versa.

Figure 8:
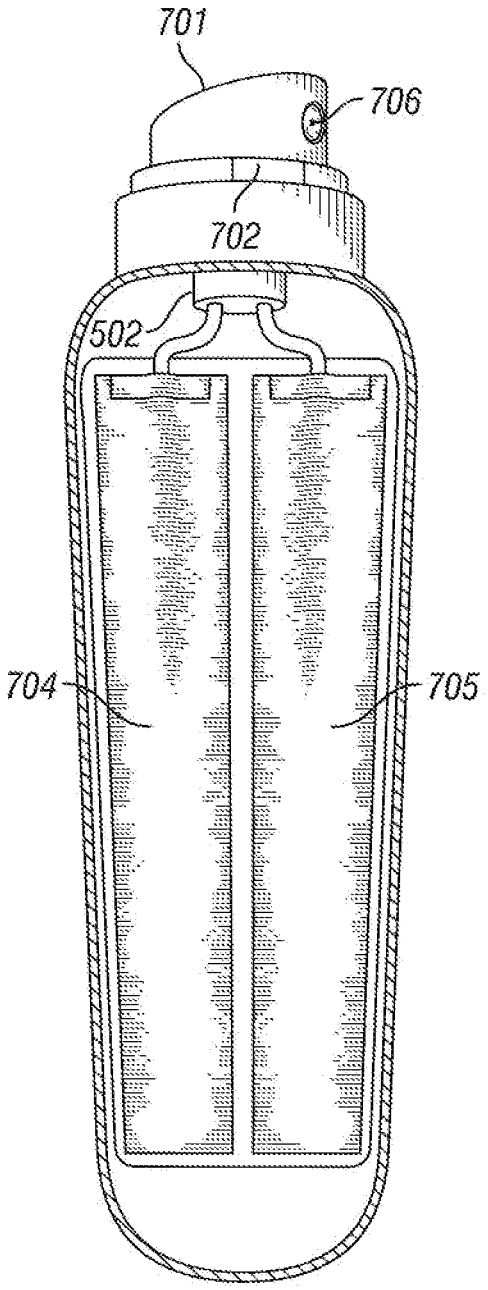
FIG. 8 is an embodiment of the use of the invention with two bags positioned side by side.
Figure 9:
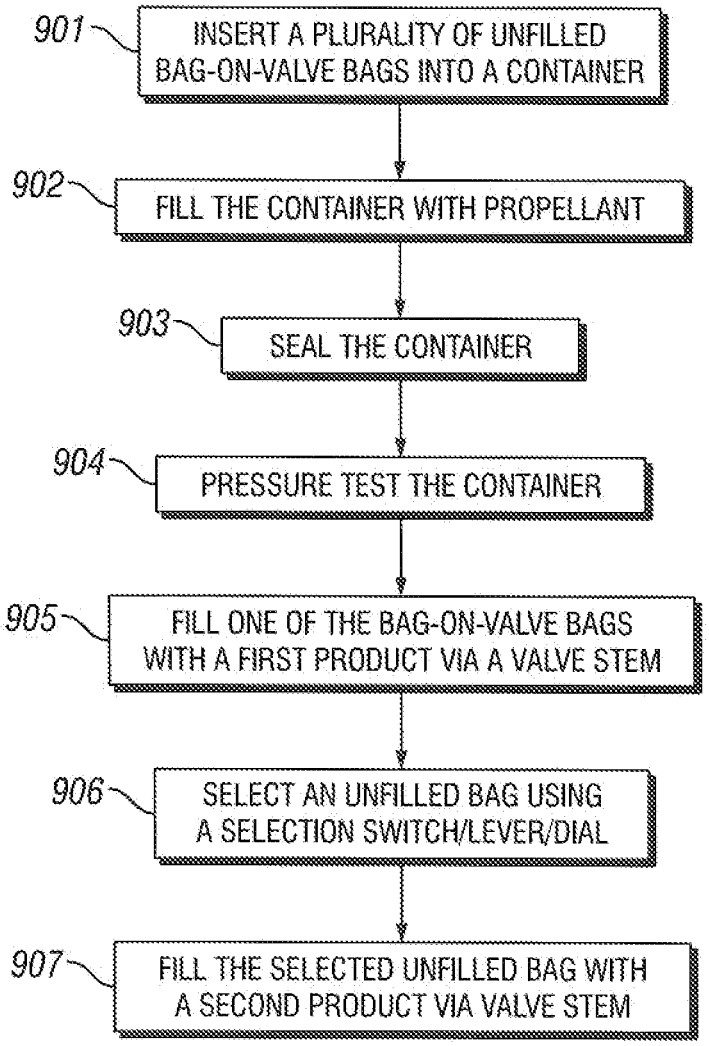
FIG. 9 is a flow chart of the steps of filling the apparatus of the invention.
Figure 10A:
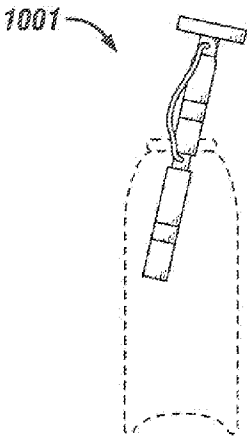
FIGS. 10A-10G illustrate the steps of the flow chart of FIG. 9.
Figure 10B:
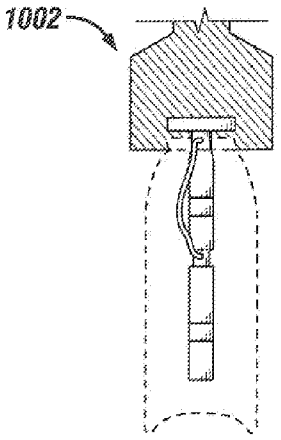
Figure 10C:
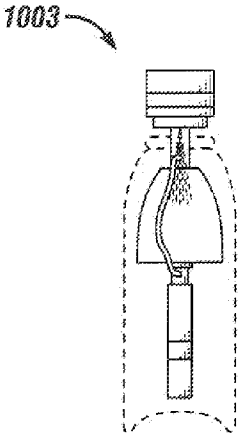
Figure 10D:
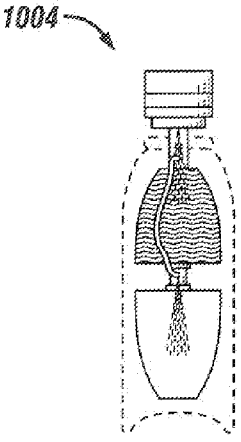
Figure 10E:
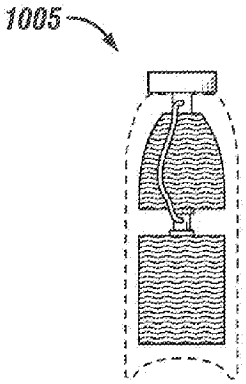
Figure 10F:
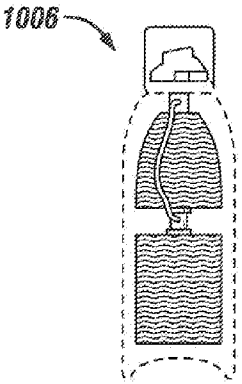
Figure 10G:
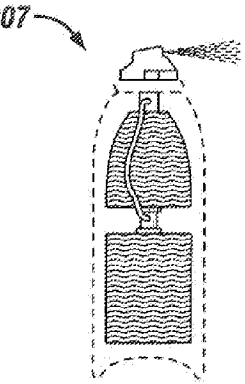
Figure 10O:
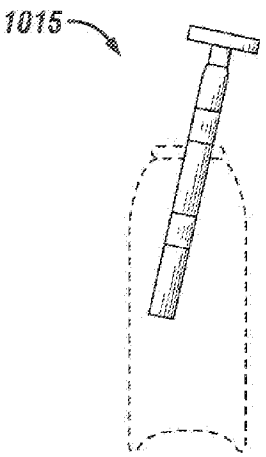
FIGS. 10O-10U illustrate an alternative way to perform the steps of FIG. 9.
Figure 10P:
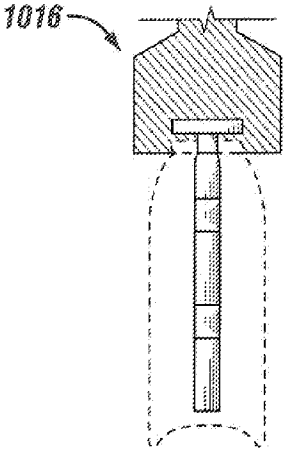
Figure 10Q:
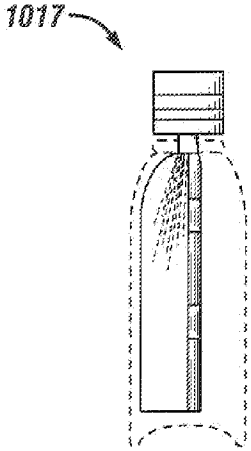
Figure 10R:
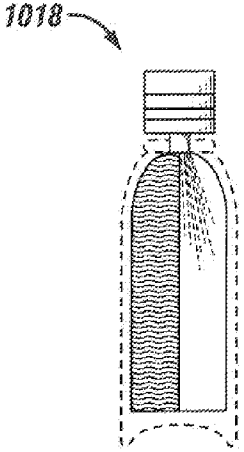
Figure 10S:
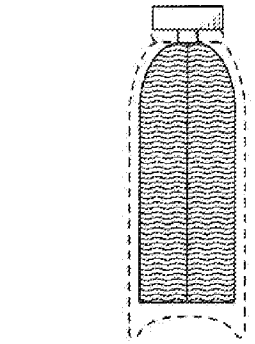
Figure 10T:
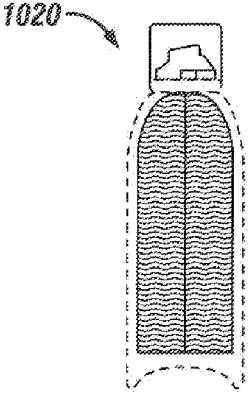
Figure 10U:
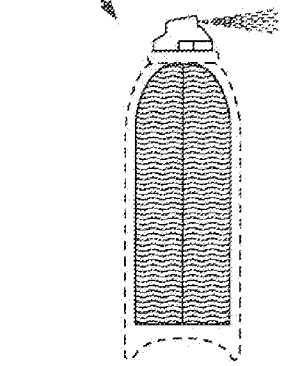

In preferred embodiments, the invention has two bags. FIG. 7 illustrates first bag 704 in a vertical position with respect to second bag 705. Dip tube 707 couples second bag 705 to valve assembly 502. FIG. 8 illustrates first bag 704 in a side-by-side position with respect to second bag 705.

In a further embodiment one of the bags contains sanitizer/disinfectant in a first bag 704 and a quick drying agent in a second bag 705. In a further embodiment, a first bag 704 holds sunscreen having a first sunscreen protection factor (SPF) and a second bag 705 holds sunscreen having a second SPF, or sunscreen with the same SPF, but with different uses, such as regular sunscreen and the other sport sunscreen. In a further embodiment, a first bag 704 holds sunscreen and a second bag 705 holds after sun care spray. In a further embodiment, a first bag 704 holds a first type of household cleaner and a second bag 705 holds a second type of household cleaner.

Although the invention is described as having two bags, any desired number of bags can be provided in the container. Further, any suitable product that is desired can be placed in a respective bag chamber so long as it can be ejected from its respective bag upon activation of the actuator.

The invention also covers a method of dispensing one of a plurality of products, comprising using the apparatus to apply a first product from a first bag when the selection switch/lever/dial is at a first position and applying a second product from a second bag when the selection switch/lever/dial is in a second position. The invention also covers a method of dispensing one of a plurality of products, comprising using the apparatus to apply a first product from a first bag when the selection switch/lever/dial is at a first position, applying a second product from a second bag when the selection switch/lever/dial is in a second position and applying a third product from a third bag when the selection switch/lever/dial is in a third position. The container can include graphics that indicate, on ½ thereof, the product in the first chamber and on the other ½ thereof, the product in the second chamber.

As seen in FIGS. 9 and 10A-10G, the invention also covers a method 900 of filling an apparatus having the assembly disclosed herein, comprising inserting a plurality of unfilled bag-on-valve bags into a container 901, 1001 filling the container with propellant 902, 1002 using, e.g., compressed gas, air or nitrogen in an under the cap, cup or similar suitable method, and sealing the container 903, pressure testing the container 904, selecting or confirming a first bag or second bag using the selection switch/lever/dial; filling the first bag to be filled with a product via the valve stem 905; 1003 selecting the other bag using the selection switch/lever/dial and filling the second bag with a second product via valve stem 907, 1004. In other embodiments, the lower bag may be filled first and the upper bag filled second as seen in steps 1008-1014 of FIGS. 10H-10O. A similar process applies to bags that are positioned side-by-side as seen in steps 1015-1021 of FIGS. 10O-10U. Referring back to FIG. 10F, in step 1006, a push button and nozzle actuator is installed on the valve assembly and in step 1007, upon actuation of the actuator, the product selected is ejected from the nozzle.

A further embodiment of the invention is a first bag located within a second bag, the contents of the first bag being isolated from the contents of the second bag. A first conduit is open to, and has an ingress from, the interior of the first bag through a second conduit that is open to, and has an ingress, from the interior of the second bag, the diameter of the first conduit being less than that of the second conduit, so as to allow product from the second bag to flow between the interior of the second conduit and exterior of the first conduit. The first conduit and second conduit meet at a blocking member as part of the nozzle assembly or actuator assembly, the blocking member having an aperture thereof coupled to a switch/lever/dial operable to move the blocking member aperture between the egress of the first conduit and the egress of the second conduit, into a chamber that leads to the valve stem. When the switch/lever/dial is put in a position to select a first bag, the blocking member aperture allows product from the first bag to enter the chamber, where it remains until an aperture on the valve stem is moved from a closed position into an open position, such as when the valve stem is caused to be moved downward into the chamber when the spring loaded nozzle actuator is depressed. When the switch/lever/dial is put in a position to select a second bag, the blocking member aperture allows product from the second bag to enter the chamber, where it remains until the aperture on the valve stem is moved from a closed position into an open position, such as when the valve stem is caused to be moved downward into the chamber when the spring loaded nozzle actuator is depressed.

The invention further comprises an apparatus for dispensing product, comprising a first bag; a second bag positioned outside the first bag, the first bag being located within the second bag wherein contents of the first bag are isolated from contents of the second bag; a first conduit open to and having an ingress from the interior of the first bag; a second conduit open to and having an ingress from the interior of the second bag; a blocking member having a top plane and a bottom plane and an aperture there-through, wherein the first conduit and second conduit each meet proximate the bottom plane of the blocking member; a switch/lever/dial coupled directly or indirectly the blocking member, the switch/lever/dial operable to reposition the blocking member, and hence the blocking member aperture between an egress of the first conduit and an egress of the second conduit; a chamber, the blocking member positioned and movable, via the switch/lever/dial, within the chamber; a spring loaded valve stem having an egress leading to a nozzle and, proximate the ingress, a valve stem aperture; and a valve stem support cylinder, the valve stem aperture being closed off by the valve stem support cylinder when the nozzle actuator is in an undepressed position and exposed and open into the disk chamber when the valve stem is in a depressed position.

The invention further covers the foregoing method wherein the first bag is designed, dimensioned and deployed so that when it is filled, it expands in a space that does not interfere with a space assigned to the second bag. For example, the bags can be arranged to expand side by side or the first bag can be positioned above the second bag, the second bag having an extended bag egress, so that when the first bag is filled, it expands in a space that does not interfere with a space assigned to the second bag. Further, in an aspect the first bag, when filled, has substantially the shape of a cylindrical torus with a diameter slightly less than that of the interior wall of the container and the second bag has substantially the shape of a cylinder, wherein the second bag is within the first bag when both are filled. The invention also includes a flexible second bag egress so as to be repositioned when the first bag is filled. The invention further covers filling the container with propellant using an under the cap filling process. The same method steps can be applied to an apparatus having three bags.

More generally, the invention is an apparatus of dispensing a plurality of products, comprising a container, a head proximate the top of the container; a nozzle on the head from which product is dispensed or sprayed; a plurality of bags, each bag having a bag outlet, a valve assembly coupling the nozzle to a selection module for selecting a bag outlet; a selection switch/lever/dial operable to select one of the bags; and an actuator operable to open a pathway from the valve assembly to the nozzle so as to release product from the selected bag. The valve assembly can be further designed to create a chamber in which product from the first chamber is not commingled with product from the second chamber.

A further embodiment of the invention has the valve assembly shown in FIGS. 5 and 6, but with a single bag coupled to first chamber egress 513 and with second chamber egress open to the interior of container. In this manner, the interior of the container acts as the second chamber. In this embodiment, product or propellant, or product and propellant can be filled in the container as the second chamber and product or product and propellant can be filled in the first chamber or first bag. The switch/lever/dial thus selects between the interior of the container or canister and the first bag.

The invention further includes the following combinations of different or similar products being contained in the plurality of bags: condiments; lotion; soap; body wash; sunscreen; sun lotion; breath spray flavors; olive oil; vinegar; liquid butter or butter substitute; lemon juice; fruit juices; flavorings; cleaners; glass cleaner; all-purpose cleaner; wood cleaner; disinfectant/sanitizer; compressed gas/air; anti-perspirant sprays; body spray; color care foam; deodorant spray; face and body mousses; foam mousse/balsams; foot deodorants; hair mousses; hair spray; insect repellent; self-tan sprays; shave gels; shaving foams; shaving, shower and cream foams; styling foams; sun care mousses.

In order to facilitate the dispensation of products having a thicker viscosity, the invention has a valve stem having a wider diameter of that used for spray projects. In order to facilitate the ejection of product, a flexible straight valve stem to the orifice or nozzle can be provided. By pressing or applying a force to the outer side wall of the flexible valve stem, an aperture at the end of the flexible straight valve stem is progressively opened. More specifically, a valve assembly has a straight valve stem being a hollow cylindrical conduit with an orifice or nozzle at a first end and an ingress at the second end. A gasketed member is operable to allow an opening into the ingress at the second end of the straight valve stem when a force is applied to the outer wall of the straight valve stem. Proximate below the internal land, an enclosed void, the hollow cylindrical hub serving as an egress from the enclosed void. In other words, proximate below, and in communication with, the end of the straight valve stem is an enclosed void, the flexible straight valve stem serving as an egress from the enclosed void. Below the enclosed void, a plurality of conduits serve as ingresses into the enclosed void. A plurality of chambers, preferentially bags in a bag-on-valve system, are provided as are a plurality of conduits, each conduit leading from a respective chamber or bag into the enclosed void. A blocking member having an aperture there-through is operable to allow a conduit from one of the plurality of conduits through the enclosed void into the flexible straight valve stem, while blocking the other conduits. A selectable switch/dial/lever is coupled directly or indirectly to the blocking member operable to allow the contents of one of the plurality of chambers to access the enclosed void. While the operation of the valve and nozzle assembly operable to select from one of a plurality of bags will be apparent from the foregoing description, it may be helpful to summarize it briefly. A propellant outside of the bags, but inside the sealed container in which the bags are positioned, applies a force against the contents of a bag, such as a food product. The propellant can be, inter alia, nitrous oxide or carbon dioxide. When the blocking member aperture is positioned over the conduit of one of the bags, it forces the food product through the blocking member aperture into the enclosed void. The food remains in the enclosed void until the flexible straight valve stem is actuated by pressing on its outer side wall so as to open the aperture at the end thereof so as to allow the food product to leave the valve stem. In the foregoing, the valve assembly has a first chamber and a second chamber, further wherein the first chamber and second chamber are bags as used in a bag on valve system. The valve assembly can be coupled to a top of a container, such as an aluminum or tin container and the bags are located therein. Propellant can be included within one or a selected number of the bags. The invention is also the foregoing valve assembly in combination with a container wherein a first chamber and a second chamber are bags as in a bag on valve system and further comprising including propellant within the container so as to exert a force against the exterior of the bags. The bags are flexible, multiple layer bags. The bags can be internally formed within one outer layer or can be arranged either vertically or side by side. Or the bags can be a bag for holding one product, an outer bag holding the sealed inner bag holding a second product, and a third bag, yet further outer bag holding propellant. When the various components are coupled indirectly, gaskets or seals may be included between such components to create impermeable seals. Such gaskets can be made, inter alia, nitrile, neoprene, butyl or chlorobutyl. The inner diameter of the various conduits, hollow tubes and valve stems are dependent on the product to be sprayed or dispensed from the plurality of chambers or bags and can, for example, may range from 0.05 millimeters to 2 millimeters or more. Further, the conduits or dip tubes leading from each chamber or bag to be placed within a single container can be differently shaped, sized or dimensioned so as to better track which chamber or bag correlates to which switch/dial/lever position. For example, a first shape and/or size leading from the first chamber or first bag may be standardized with switch/dial/lever position 1 and a different shape and/or size leading from the second chamber or second bag may be standardized with switch/dial/lever position 2.

The first bag and second bag contain combinations of different or similar products such as condiments; edible creams, lotion; soap; body wash; sunscreen; sun lotion; breath spray flavors; olive oil; vinegar; liquid butter or butter substitute; lemon juice; fruit juices; flavorings; cleaners; glass cleaner; all-purpose cleaner; wood cleaner; disinfectant/sanitizer; compressed gas/air; anti-perspirant sprays; body spray; color care foam; deodorant spray; face and body mousses; foam mousse/balsams; foot deodorants; hair mousses; hair spray; insect repellent; self-tan sprays; shave gels; shaving foams; shaving, shower and cream foams; styling foams; suncare mousses.

While the present invention has been described by reference to certain embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. An apparatus for dispensing a plurality of products, consisting of:

a container;

a nozzle assembly coupled to the container having a single nozzle or orifice from which product is dispensed or sprayed from within one of two selectable bag-on-valve bags, wherein each bag is a pouch operable to isolate its contents from the contents in the other pouch;

two selectable bag-on-valve bags positioned within the container, said bag on valve bags manufactured from a mylar, polyethylene or polypropylene material having multiple layers of one or more flexible materials laminated together as an integral unit;

each of said bag-on-valve bags having a separate conduit from the interior thereof into the nozzle assembly, wherein the nozzle assembly has only one of 3 states: (1) each conduit is simultaneously entirely closed, or (2) the conduit from the first bag-on-valve bag is entirely open for fluid communication with the single nozzle or orifice and the conduit from the second bag-on-valve bag is entirely closed to the single nozzle or orifice or (3) the conduit from the second bag-on-valve bag is entirely open for fluid communication with the single nozzle or orifice and the conduit from the first bag-on-valve bag is entirely closed to the single nozzle or orifice, the state of (1), (2) or (3) being determined by the position of the blocking/unblocking member via the switch/lever/dial;

an actuator appurtenant to the nozzle assembly operable to release product from the selected bag-on-valve bag;

a propellant sealed inside the container but external to the bag-on-valve bags; and a switch/lever/dial movably coupled to the nozzle assembly and responsively coupled to a blocking/unblocking member, operable to open a conduit to the selected bag-on-valve bag from which the product is to be dispensed or sprayed when the actuator is depressed or otherwise actuated.

2. The apparatus of claim 1, wherein the two bag on valve bags comprise a first bag and a second bag wherein the first bag contains a first type of sunscreen and the second bag contains a second type of sunscreen.

3. The apparatus of claim 1, wherein the two bag on valve bags comprise a first bag and a second bag wherein the first bag contains a first type of sunscreen and the second bag contains an after sun product.

4. The apparatus of claim 1, wherein the two bag on valve bags comprise a first bag and a second bag wherein the first bag contains liquid soap and the second bag contains hand sanitizer.

5. The apparatus of claim 1, wherein the two bag on valve bags comprise a first bag and a second bag wherein the first bag contains liquid soap and the second bag contains hand lotion.

6. The apparatus of claim 1, wherein the two bag on valve bags comprise a first bag and a second bag wherein the first bag contains hand sanitizer and the second bag contains hand lotion.

7. The apparatus of claim 1, wherein the two bag on valve bags comprise a first bag and a second bag wherein the first bag contains foamed soap and the second bag contains liquid soap.

8. The apparatus of claim 1, wherein the two bag on valve bags comprise a first bag and a second bag wherein the first bag contains foamed soap and the second bag contains hand sanitizer.

9. The apparatus of claim 1, wherein the two bag on valve bags comprise a first bag and a second bag wherein the first bag contains a type of olive oil and the second bag contains a type of vinegar.

10. The apparatus of claim 1, wherein the two bag on valve bags comprise a first bag and a second bag wherein the first bag contains a type of olive oil and the second bag contains a type of vinegar.

11. The apparatus of claim 1, wherein the two bag on valve bags comprise a first bag and a second bag wherein the first bag contains a first type of edible flavored sauce and the second bag contains a second type of edible flavored sauce.

12. The apparatus of claim 1, wherein the two bag on valve bags comprise a first bag and a second bag wherein the first bag contains a type of body wash and the second bag contains a type of hair shampoo.

13. The apparatus of claim 1, wherein the two bag on valve bags comprise a first bag and a second bag wherein the first bag contains a type of hair shampoo and the second bag contains a type of hair conditioner.

14. The apparatus of claim 1, wherein the two bag on valve bags comprise a first bag and a second bag wherein the first bag contains a first type of hair gel product and the second bag contains a second type of hair gel product.

15. The apparatus of claim 1, wherein the two bag on valve bags comprise a first bag and a second bag wherein the first bag contains a first type of hair mousse product and the second bag contains a second type of hair mousse product.

16. The apparatus of claim 1, wherein the two bag on valve bags comprise a first bag and a second bag wherein the first bag contains a first type of hair gel product and the second bag contains a second type of hair mousse product.

17. The apparatus of claim 1, wherein the two bag on valve bags comprise a first bag and a second bag wherein the first bag contains a first type of topical medical product and the second bag contains a second type of topical medical product.

18. The apparatus of claim 17, wherein the first type of topical medical product and the second type of topical medical product require the use of sterilized bags.

19. The apparatus of claim 1, wherein the two bag on valve bags comprise a first bag and a second bag wherein the first bag contains a sanitizing product and the second bag contains a topical medicating product.

20. A valve assembly for a container having multiple chambers, comprising:

a head having a nozzle from which product is dispensed or sprayed;

a barrel in communication with the nozzle;

a nozzle actuator, which may comprise the top of the nozzle or head or a pushbutton actuator;

a valve assembly including a compressible spring;

a hollow valve stem;

the spring being axially inserted into the valve stem and seated so as to spring load the valve stem within a valve stem support cylinder or positioned so as to load the valve stem;

a valve stem egress at the top of the valve stem, the valve stem egress coupled to the nozzle and in communication with the barrel, the valve stem egress acting as a conduit from the hollow valve stem into the barrel;

a valve stem support cylinder in which the valve stem is movable vertically in a reciprocating manner when the nozzle actuator is depressed and then released;

the valve stem further rotatable in a circular fashion within the valve stem support cylinder;

a circular disk axially coupled to the bottom of the valve stem, operable to rotate when the valve stem is rotated;

a disk chamber in which the disk is free to move vertically in a reciprocating manner when the valve stem is depressed and around its center when the valve stem is rotated;

the valve stem further having a valve stem aperture on a side wall of the valve stem proximate the bottom of the valve stem, the aperture being closed off against the inner wall of the valve stem support cylinder when the nozzle actuator is in an undepressed position and exposed and open into the disk chamber when the valve stem is in a depressed position;

the disk having at least one disk aperture therethrough;

a first chamber egress (such as a hollow tube) acting as a conduit from a first chamber and a second chamber egress (also such as a hollow tube) acting as a conduit from a second chamber, wherein the disk aperture can be either in a closed position or in a first chamber open position or in a second chamber open position; and a selection switch/lever/dial coupled to the valve stem operable to rotate the valve stem, and hence the disk, and hence the disk aperture, so as to select which chamber from which product is to be ejected from the nozzle.

21. The valve assembly of claim 20, further comprising a disk key and disk chamber keyhole on the floor of the disk chamber operable to allow the nozzle actuator to be depressed only when the first chamber or second chamber is selected.

22. The valve assembly of claim 20, further providing a splined portion on the valve stem operable to mate with an interior splined portion of a pushbutton or nozzle actuator.

23. The valve assembly of claim 20, further providing a flapper or one way valve within the first chamber or between the first chamber egress and the first chamber egress and between the second chamber egress and the second chamber.

24. The valve assembly of claim 20, further comprising a first chamber and a second chamber wherein the first chamber and second chamber are separate tin or aluminum chambers within a container or are plastic bags or are bags as used in a bag on valve systems.

25. The valve assembly of claim 20, wherein the valve assembly is coupled to a top of a container, such as an aluminum or tin container and the chambers located therein.

26. The valve assembly of claim 25, further comprising propellant included with in one or a selected number of the bags.

27. The valve assembly of claim 25, in combination with a container within which the first chamber and second chamber are inserted.

28. The valve assembly of claim 27, wherein a first chamber and a second chamber are bags as in a bag on valve system and further comprising including propellant within the container so as to exert a force against the exterior of the bags.

29. The valve assembly of claim 28, wherein the bags are flexible, multiple layer bags.

30. The valve assembly of claim 29, wherein the bags are internally formed within one outer layer.

31. The valve assembly of claim 30, wherein the internally formed bags are arranged either vertically or side by side.

32. The valve assembly of claim 28, wherein the first bag and second bag contain combinations of different or similar products such as condiments; lotion; soap; body wash; sunscreen; sun lotion; breath spray flavors; olive oil; vinegar; liquid butter or butter substitute; lemon juice; fruit juices; flavorings; cleaners; glass cleaner; all-purpose cleaner; wood cleaner; disinfectant/sanitizer; compressed gas/air; anti-perspirant sprays; body spray; color care foam; deodorant spray; face and body mousses; foam mousse/balsams; foot deodorants; hair mousses; hair spray; insect repellent; self-tan sprays; shave gels; shaving foams; shaving, shower and cream foams; styling foams; suncare mousses.

33. The valve assembly of claim 32, further comprising either (i) a first bag containing sunscreen with one sunscreen protection factor (SPF) and a second bag containing sunscreen with a different SPF or (ii) a first bag and a second bag each containing sunscreen having the same SPF, but different ingredients so as to provide use in a different context.

34. The valve assembly of claim 29, wherein the first bag is designed, dimensioned and deployed so that when it is filled, it expands in a space that does not interfere with a space assigned to the second bag.

35. The valve assembly of claim 29, wherein the first bag is positioned above the second bag, the second bag having an extended bag outlet, so that when the first bag is filled, it expands in a space that does not interfere with a space assigned to the second bag.

36. The valve assembly of claim 29, wherein the first bag and the second bag are positioned side by side.

* * * * *